US010239730B2

(12) United States Patent
Seki

(10) Patent No.: US 10,239,730 B2
(45) Date of Patent: Mar. 26, 2019

(54) BUILDING SWAY OPERATION SYSTEM

(71) Applicant: Otis Elevator Company, Farmington, CT (US)

(72) Inventor: Hisanori Seki, Tomisato (JP)

(73) Assignee: OTIS ELEVATOR COMPANY, Farmington, CT (US)

( * ) Notice: Subject to any disclaimer, the term of this patent is extended or adjusted under 35 U.S.C. 154(b) by 48 days.

(21) Appl. No.: 15/500,362

(22) PCT Filed: Jul. 27, 2015

(86) PCT No.: PCT/US2015/042189
§ 371 (c)(1),
(2) Date: Jan. 30, 2017

(87) PCT Pub. No.: WO2016/018786
PCT Pub. Date: Feb. 4, 2016

(65) Prior Publication Data

US 2017/0210597 A1 Jul. 27, 2017

Related U.S. Application Data

(60) Provisional application No. 62/031,206, filed on Jul. 31, 2014.

(51) Int. Cl.
*B66B 5/02* (2006.01)
*B66B 5/04* (2006.01)
*E04H 9/02* (2006.01)

(52) U.S. Cl.
CPC ..... *B66B 5/022* (2013.01); *B66B 5/04* (2013.01); *B66B 5/02* (2013.01); *B66B 5/021* (2013.01); *B66B 5/025* (2013.01); *E04H 9/02* (2013.01)

(58) Field of Classification Search
CPC .. B66B 5/022; B66B 5/04; B66B 5/02; B66B 5/021; B66B 5/025
USPC ..... 187/278
See application file for complete search history.

(56) References Cited

U.S. PATENT DOCUMENTS 4,056,169 A 11/1977 Showalter
4,643,276 A 2/1987 Philobos
5,022,201 A * 6/1991 Kobori ..... E04B 1/985 52/167.2
5,103,937 A 4/1992 Robertson
(Continued)

FOREIGN PATENT DOCUMENTS

JP 2000045568 A 2/2000
JP 3662304 B2 6/2005
(Continued)

OTHER PUBLICATIONS

International Search Report and Written Opinion for application for PCT/US2015/042189, dated Oct. 12, 2015, 10 pages.

*Primary Examiner* — David Warren
(74) *Attorney, Agent, or Firm* — Cantor Colburn LLP

(57) ABSTRACT

An exemplary building sway operation system (10) for an elevator includes an acceleration sensor (11), and a data receiving unit (12) for receiving a sensor output from the acceleration sensor (11). The acceleration sensor (11) is designed to be mounted on a movable mass (6) of an active vibration control device (5) for a building, in order to detect the reciprocating motion of the movable mass (6) of the active vibration control device (5) responsive to the occurrence of earthquakes or strong winds.

5 Claims, 5 Drawing Sheets

(56) References Cited

U.S. PATENT DOCUMENTS

| | | | | |
|---|---|---|---|---|
| 5,861,084 | A | 1/1999 | Barker et al. | |
| 7,793,763 | B2 | 9/2010 | Zhu et al. | |
| 7,905,329 | B2 | 3/2011 | Urata | |
| 7,926,620 | B2 | 4/2011 | Amano | |
| 8,123,002 | B2 | 2/2012 | Smith et al. | |
| 8,297,412 | B2 | 10/2012 | Roberts | |
| 8,579,089 | B2 | 11/2013 | Hakala et al. | |
| 9,914,619 | B2 * | 3/2018 | Roberts | B66B 5/022 |
| 2009/0133963 | A1 | 5/2009 | Amano | |
| 2009/0308697 | A1 * | 12/2009 | Boschin | B66B 7/042 187/409 |
| 2010/0065381 | A1 | 3/2010 | Roberts et al. | |
| 2012/0097487 | A1 | 4/2012 | Winey | |
| 2012/0125720 | A1 | 5/2012 | Roberts et al. | |
| 2013/0213742 | A1 * | 8/2013 | Hakala | B66B 1/24 187/247 |
| 2014/0000985 | A1 * | 1/2014 | Fukui | B66B 5/0031 187/247 |
| 2014/0131141 | A1 * | 5/2014 | Tanaka | B66B 1/28 187/278 |
| 2015/0246791 | A1 * | 9/2015 | Smith | B66B 7/06 187/264 |
| 2016/0244298 | A1 * | 8/2016 | Roberts | B66B 5/022 |
| 2016/0272463 | A1 * | 9/2016 | Benosman | B66B 5/0018 |
| 2017/0210597 | A1 * | 7/2017 | Seki | B66B 5/022 |
| 2017/0260025 | A1 * | 9/2017 | Benosman | B66B 1/30 |

FOREIGN PATENT DOCUMENTS

| | | | |
|---|---|---|---|
| JP | 2007320685 | A | 12/2007 |
| WO | 2013184085 | A1 | 12/2013 |

* cited by examiner

BUILDING SWAY OPERATION SYSTEM

TECHNICAL FIELD

The present invention relates to a building sway operation system for high-rise buildings. More specifically, the present invention relates to a building sway operation system which can perform elevator control in response to a building sway due to earthquakes or strong winds.

BACKGROUND ART

In recent years, demand for high-rise buildings with a plurality of elevators has been increasing. In such high-rise buildings, when building sways or shakings occur due to strong winds and earthquakes, long members such as control cables and tension members of elevator systems tend to swing and collide against elevator equipments or caught by support members located within a hoistway, which can cause damage to the elevator equipments, control cables and tension members.

As a prior art detection device which performs elevator control by detecting the swinging or sway of a building caused by earthquakes or strong winds, Japanese Patent Publication No. 2007-153520 A discloses a building sway detector operation device including two pendulum sensors. These pendulum sensors are used for detecting the swing of the pendulums corresponding to shaking degree of the building. If pendulums arranged within respective cylinders of the pendulum sensors swing and collide against the inner periphery of the cylinders, the sensors transmit detection signals. The pendulum sensor cylinder of larger inner diameter detects the larger amplitude of a long-period earthquake.

However, such building sway detection operation apparatus is large and expensive. Typically, the average pendulum wire length is about 2 to 3 meters depending on the size of buildings, and thus a large space is required for the installation location. Furthermore, since the installation locations and installation conditions are different depending on the buildings, it is necessary to calibrate the length of the wire of the pendulums in each building.

Japanese Patent No. 5,205,969 discloses an elevator control system equipped with a seismic sensor comprising a two-dimensional accelerometer installed in the machine room of a building. However, such seismic sensor comprising a two-dimensional accelerometer is not able to detect long-period earthquakes in the same way as the pendulum sensors of Japanese Patent Publication No. 2007-153520 A. In this case, alternative detection means is required for detection of long-period earthquakes. Moreover, such an elevator control system is extremely difficult to retrofit to pre-existing elevator systems because of its complex mechanisms.

Meanwhile, there are a variety of well-known vibration control devices for damping vibrations or amplitudes of the building sway which is caused by strong winds or earthquakes including long-period earthquakes. Japanese Patent Publication No. 2010-255791 A discloses a conventional, active-type vibration control device which is installed in the upper portion of a high-rise building, so as to reduce the vibration or sway of the building during high winds or earthquakes. This type of active vibration control device is configured such that when the vibration control device detects the sway of the building due to earthquakes or strong winds, the movable mass on the vibration control device is driven by actuators to reciprocate with a phase lag of 90 degrees with respect to the amplitude of the building sway in such a way to reduce the amplitude of the sway of the building.

However, such devices are specialized in the damping of buildings, it is not possible to control the operation of elevators arranged in a high-rise building.

SUMMARY

According to exemplary embodiments, a building sway operation system for an elevator includes an acceleration sensor, and a data receiving unit for receiving a sensor output from the acceleration sensor. The acceleration sensor is designed to be mounted on a movable mass of an active vibration control device for a building, in order to detect the reciprocating motion of the movable mass of the active vibration control device responsive to the occurrence of earthquakes or strong winds.

Additionally or alternatively, embodiments may include one or more of the following features in various combinations: the acceleration sensor is powered by wireless power transfer from the data receiving unit.

Additionally or alternatively, embodiments may include one or more of the following features in various combinations: the acceleration sensor transmits the sensor output to the data receiving unit via wireless communication.

Additionally or alternatively, embodiments may include one or more of the following features in various combinations: the data receiving unit is configured to calculate a moving distance of the building sway per unit time from the sensor output received from the acceleration sensor, and calculate an amplitude value of the building sway from the moving distance of the building sway per unit time.

Additionally or alternatively, embodiments may include one or more of the following features in various combinations: the data receiving unit determines a level of the building sway by comparing the amplitude value of the building sway with at least one threshold value.

Additionally or alternatively, embodiments may include one or more of the following features in various combinations: the data receiving unit transmits to at least one elevator control system a control signal for controlling an elevator operation according to the level of the building sway.

These and other embodiments will become more readily apparent from the following description and the accompanying drawings, which can be briefly described as follows.

DESCRIPTION OF EMBODIMENTS

Figure 1:
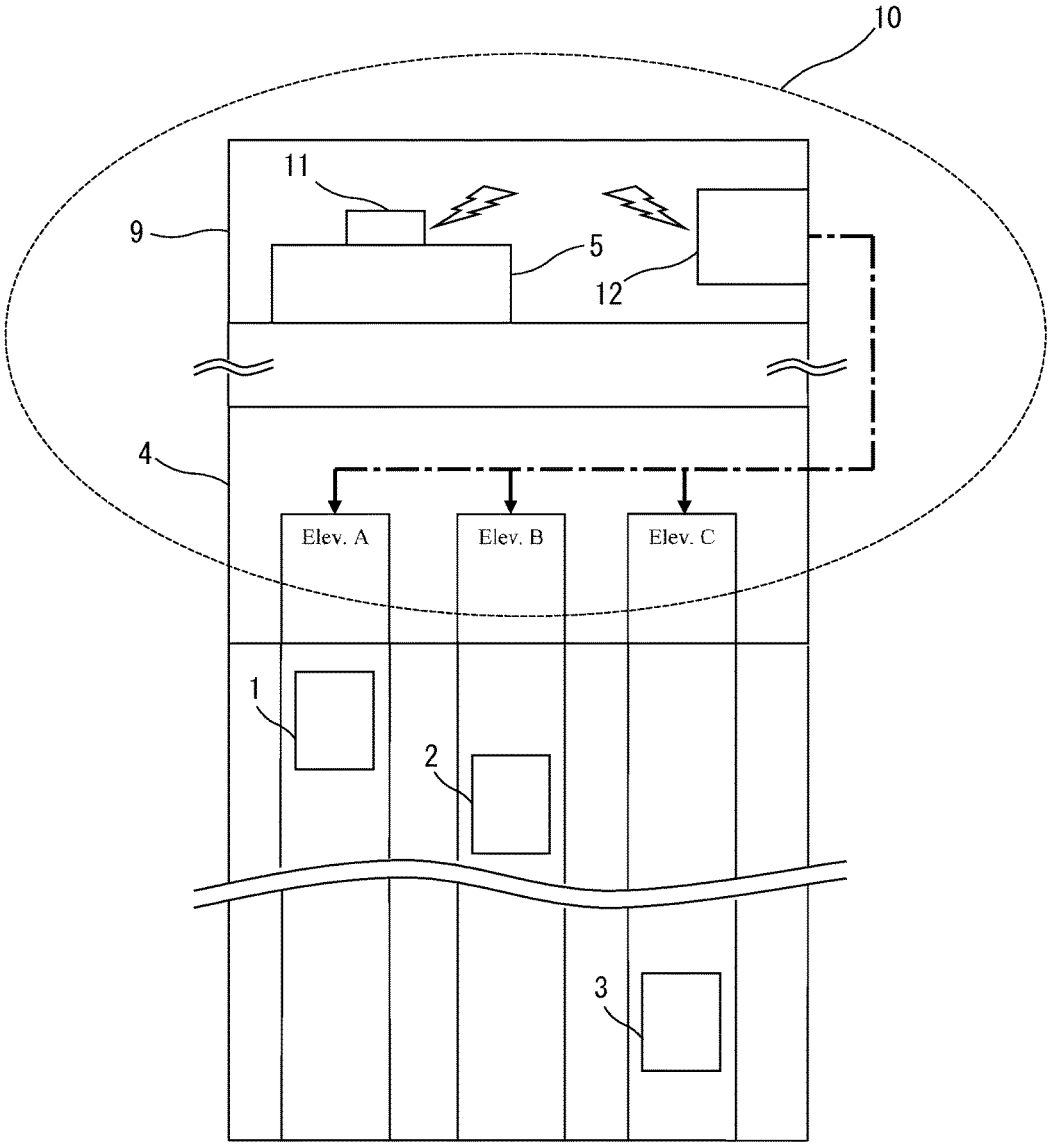
FIG. 1 is a schematic view showing one possible arrangement of a building sway operation system according to exemplary embodiments.

FIG. 1 schematically shows an elevator system with a plurality of elevators A-C arranged within a high-rise building. Three elevators A-C are shown for illustrative purposes only. An elevator system may comprise any appropriated number and configuration of elevators. The elevator system comprises a plurality of elevator cars 1-3, each located within a respective hoistway A-C. An elevator machine room 4 is arranged above the hoistway A-C of the elevator cars 1-3 where a plurality of control devices are installed for performing management and control for each of the elevators A-C. On the upper floor above the machine room 4, a vibration control device room is further provided where a conventional, active-type vibration control device 5 as described, for example, in Japanese Patent Publication No. 2010-255791 A is installed so as to reduce the vibration of a building during high winds or earthquakes.

As shown in FIG. 1, a part of a building sway operation system 10 according to exemplary embodiments is arranged within the vibration control device room 9, which includes a wireless powered acceleration sensor package 11 mounted on the vibration control device 5; and a wireless receiving unit 12 that is configured to provide wireless power supply to the acceleration sensor package 11 and receive wireless data transmitted from the acceleration sensor package 11. The acceleration sensor package 11 is attached to the movable mass 6 (see FIG. 2) which is placed on the vibration control device 5 so as to be able to reciprocate along the shaking of the building during high winds or earthquakes, as described below in detail. In one embodiment, the wireless receiving unit 12 is attached on the building wall and powered from a normal power outlet. However, the wireless receiving unit 12 may be placed in any location capable of performing wireless communication and wireless power feeding to the acceleration sensor package 11, and it may be powered by any other power source such as an elevator power source, a battery, etc.

Also, while the acceleration sensor package 11 according to one embodiment has been described as being powered by wireless power transfer, it should be appreciated that the acceleration sensor package 11 could be powered by a wired power source or could be powered by a battery.

Figure 2:
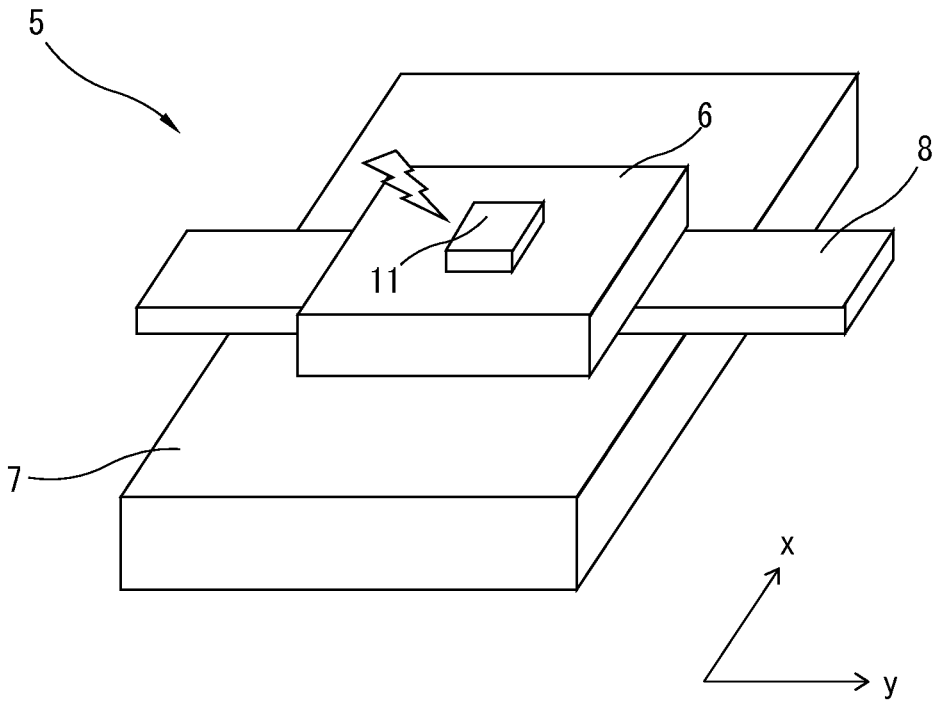
FIG. 2 is a perspective view showing an acceleration sensor package of the building sway operation system according to exemplary embodiments which is installed on the exterior of a movable mass of an active vibration control device.

FIG. 2 is a perspective view showing the acceleration sensor package 11 of the building sway operation system 10 of exemplary embodiments that is attached to the movable mass 6 on the vibration control device 5.

The vibration control device 5 is a known, active-type vibration control device which is provided so as to reduce the vibration or sway of a building during high winds or earthquake. The vibration control device 5 includes a base portion 7, a guide rail 8 arranged on the base portion 7 that is movable in the x-direction shown in FIG. 2, and the movable mass 6 disposed on the guide rail 8 that is movable in the y-direction shown in FIG. 2. The vibration control device 5 also includes a controller (not shown) for detecting a sway of the building due to earthquakes or strong winds and driving the movable mass 6 to reciprocate along a desired direction in response to the detection of the building sway. The movable mass 6 is driven in the x-direction and/or y-direction by actuators to reciprocate with a phase lag of 90 degrees with respect to the amplitude of the sway of the building due to earthquakes or strong winds, in order to attenuate the amplitude of the sway of the building.

The acceleration sensor package 11 of exemplary embodiments is configured to detect the reciprocating motion of the movable mass 6, instead of detecting the sway of the building itself. As the reciprocating motion of the movable mass 6 is amplified in comparison to the sway of the building, it is not necessary to provide a complicated detection mechanism to accurately detect the sway of the building itself. Accordingly, the building sway operation system 10 of exemplary embodiments can ensure the detection of the swing or sway of the building even using compact and inexpensive acceleration sensors. Further, since the acceleration sensor package 11 of exemplary embodiments is configured to be disposed on the active-type vibration control system, it is also possible to perform a detection test of the acceleration sensor package 11 by driving the movable mass 6 for a test operation. In addition, the acceleration sensor package 11 of exemplary embodiments may be placed in any desirable position on the movable mass 6 capable of detecting the movement of the movable mass 6 along the sway or swinging direction of the building (i.e., x-direction and y-direction).

Figure 3:
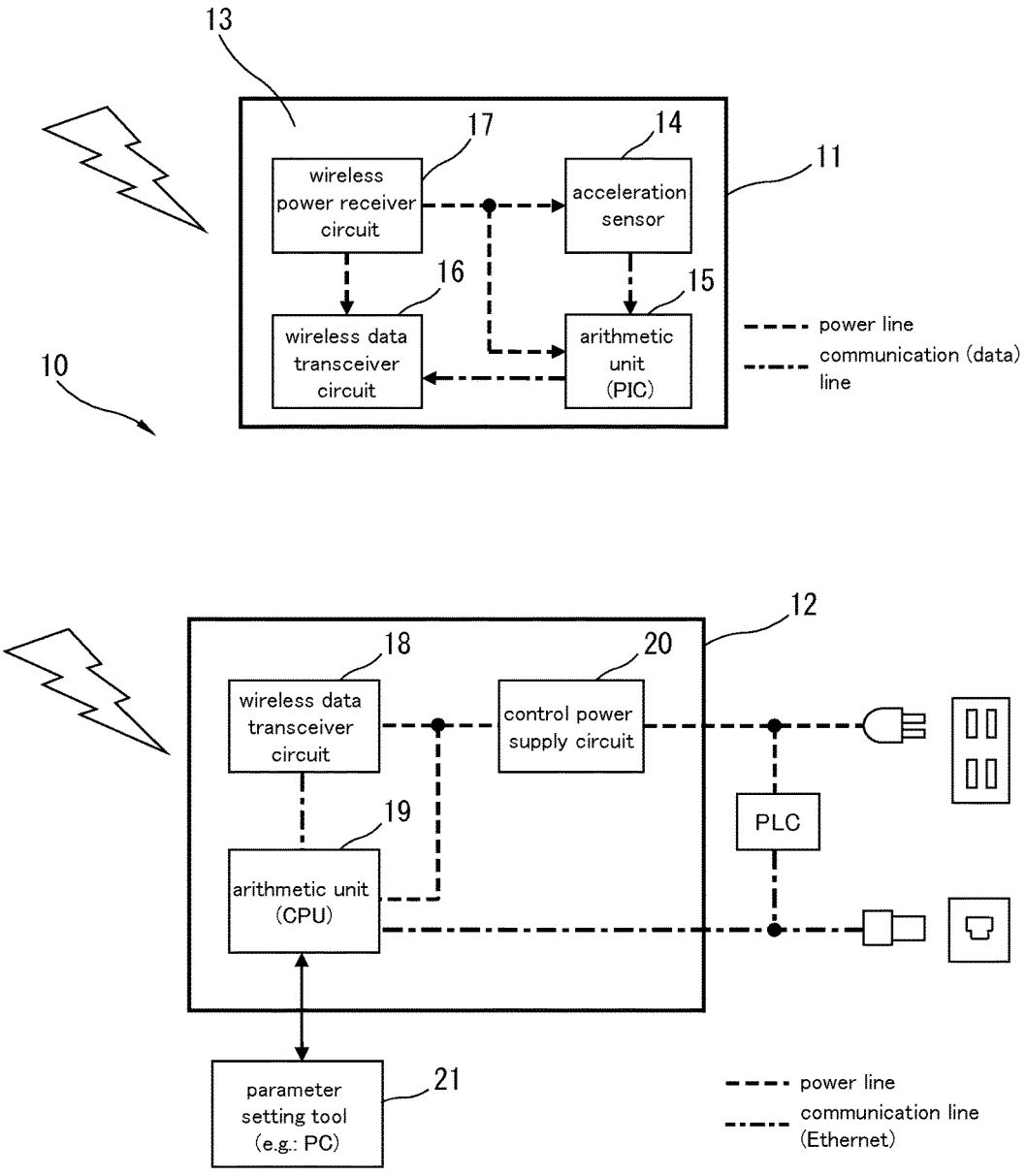
FIG. 3 is a block diagram showing a wireless powered acceleration sensor package and a wireless receiving unit according to exemplary embodiments.

FIG. 3 is a block diagram showing a building sway operation system 10 according to one embodiment including the acceleration sensor package 11 and the wireless receiving unit 12.

The acceleration sensor package 11 includes an acceleration sensor 14 which consists of integrated circuit disposed on the acceleration sensor circuit board 13, a first arithmetic unit (Peripheral Interface Controller, or PIC) 15 for calculating a sensor output value from a detected signal of the acceleration sensor 14, a first wireless data transceiver circuit 16 configured to send the sensor output value of the acceleration sensor 14 to the wireless receiving unit 12 by means of wireless signal, and a wireless power receiver circuit 17 for receiving wireless power supply from the wireless receiving unit 12. The electric power which is supplied through wireless power transfer is provided from the wireless power receiver circuit 17 through power line (indicated by a dotted line in FIG. 3) to each of the acceleration sensor 14, the first arithmetic unit (PIC) 15 and the first wireless data transceiver circuit 16. Such an acceleration sensor package 11 is mounted on the movable mass 6 of an active-type vibration control device 5 which is well-known in the art, and the acceleration sensor 14 detects the acceleration of the movable mass 6 that is reciprocating in response to the sway of the building due to strong winds or earthquakes. The detected signal from the acceleration sensor 14 is sent via a communication (data) line (shown by a dashed line in FIG. 3) to the first arithmetic unit (PIC) 15 to produce a sensor output value, and the sensor output value obtained from the first arithmetic unit (PIC) 15 is further sent via the first wireless data transceiver circuit 16 to a second wireless data transceiver circuit 18 within the wireless receiving unit 12.

In another embodiment, the acceleration sensor package 11 may be powered by a wired power source or may be powered by a battery. In this case, the acceleration sensor package 11 need not be provided with the wireless power receiver circuit 17. However, the acceleration sensor package 11 transmits sensor output to the wireless receiving unit 12 via wireless communication.

The wireless receiving unit 12 comprises a second wireless data transceiver circuit 18, a second arithmetic unit (CPU) 19, and a control power supply circuit 20.

The second wireless data transceiver circuit 18 is configured to wirelessly receive sensor output value sent from the first wireless data transceiver circuit 16 of the acceleration sensor package 11, and configured to supply electric power to the acceleration sensor package 11 through wireless power transfer.

The control power supply circuit 20 is configured to supply electrical power via power line (dotted line) to the second wireless data transceiver circuit 18 and the second arithmetic unit (CPU) 19, and configured to supply wireless power via the second wireless data transceiver circuit 18 to the acceleration sensor package 11. The control power supply circuit 20 is powered from a normal power supply that is installed in a building (i.e. outlet). However, it may be powered from any other power source such as an elevator power source, a battery, etc.

The second arithmetic unit (CPU) 19 is configured to calculate a moving distance of the building sway per unit time from the sensor output value received from the acceleration sensor package 11, followed by calculating an amplitude value of the building sway from the moving distance of the building sway per unit time. The moving distance of the building sway per unit time is calculated based on parameters of the active-type vibration control device installed in the building. The parameters of the active-type vibration control device can be set by using a parameter setting tool 21 such as PC, which is connected to the second arithmetic unit (CPU) 19 via wired or wireless connection.

Further, the second arithmetic unit (CPU) 19 is configured, as described below in detail, to compare the amplitude value of the building sway with at least one predetermined threshold value, and configured to transmit to the respective control units of the elevators a control signal for controlling the operation of the plurality of elevators according to the level of the amplitude value of the building sway. The control signal is transmitted to the respective control units of the elevators through a communication line such as Ethernet, power line communication (PLC), etc., or any other wired or wireless means.

The operation of the building sway operation system 10 of exemplary embodiments having the abovementioned configuration is now described with reference to FIG. 4.

When the vibration control device 5 detects the sway of the building due to earthquakes or strong winds, the movable mass 6 is driven in the x-direction and y-direction by actuators to reciprocate with a phase lag of 90 degrees with respect to the amplitude of the building sway in such a way to reduce the amplitude of the sway of the building.

Subsequently, the acceleration sensor 14 of the acceleration sensor package 11 which is placed on the movable mass 6 detects the acceleration of the reciprocating motion of the movable mass 6 in the x-direction and y-direction, rather than detecting the sway of the building. The acceleration sensor then outputs a detected signal from the acceleration sensor 14 to the first arithmetic unit (PIC) 15 (Step 1).

The first arithmetic unit (PIC) 15 calculates a sensor output value from the detected signal and transmits the sensor output value via the first wireless data transceiver circuit 16 to the second wireless data transceiver circuit 18 within the wireless receiving unit 12 (Step 2).

Upon receiving the sensor output value in the second wireless data transceiver circuit 18 of the wireless receiving unit 12, the sensor output value is transmitted to the second arithmetic unit (CPU) 19 (Step 3). The second arithmetic unit (CPU) 19 calculates a moving distance of the building sway per unit time from the sensor output value on the basis of the parameters of the active-type vibration control device that is set in advance (e.g. using parameter setting tools 21) (Step 4).

Then, the amplitude of the building sway is calculated from the moving distance of the building sway per unit time (Step 5). From this amplitude of the building sway, the level of the building sway is determined.

The level of the building sway can be evaluated by comparing the amplitude of the building sway with at least one predetermined threshold value of the building sway, as will be described in detail below with reference to FIG. 5 (Step 6).

A vibration detection signal corresponding to the level of the building sway that is evaluated in step 6 is transmitted to the respective control units of the elevators A-C via communication line (as shown with dashed line in FIG. 1) such as Ethernet, power line communication (PLC), etc. or any other wired or wireless means (Step 7).

Subsequently, the vibration detection signal is received by each of the control units of the elevators A-C via communication line (dashed line in FIG. 1) such as Ethernet, power line communication (PLC), etc. or any other wired or wireless means (Step 8).

The vibration detection signal of the building sway transmitted to the respective control units of the elevators can be evaluated on the basis of the existing settings of the elevator systems installed within the building, and can be used for controlling an elevator operation corresponding to the level of the building sway (Step 9).

It should be understood that the operation of an elevator system in response to the vibration detection signal of the building sway could be carried out by group management control system for centrally managing a plurality of elevators, or it could be carried out independently by each of the controllers of a plurality of elevators.

Figure 5:
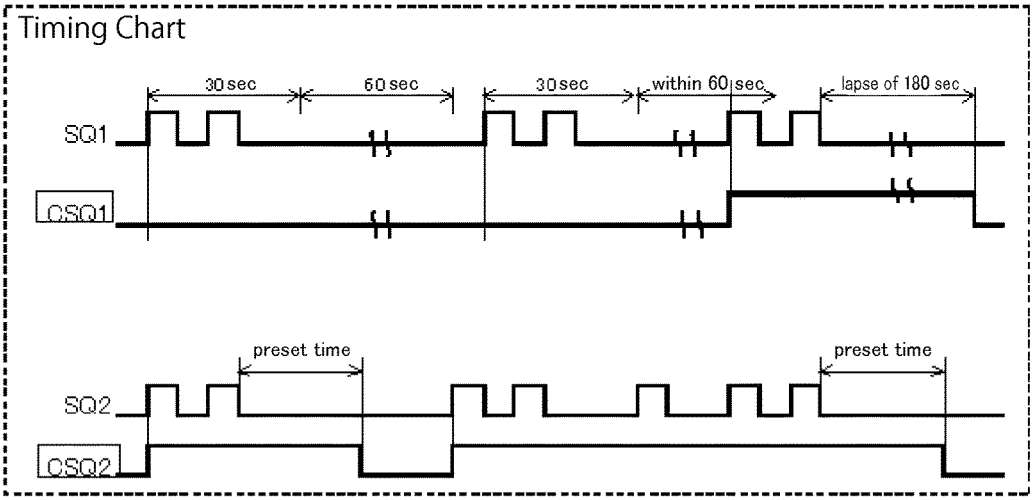
FIG. 5 is a timing chart showing a method of evaluating the level of the building sway.

Referring to FIG. 5, a timing chart is provided showing an exemplary method of evaluating the level of the building sway in accordance with one embodiment.

Figure 4:
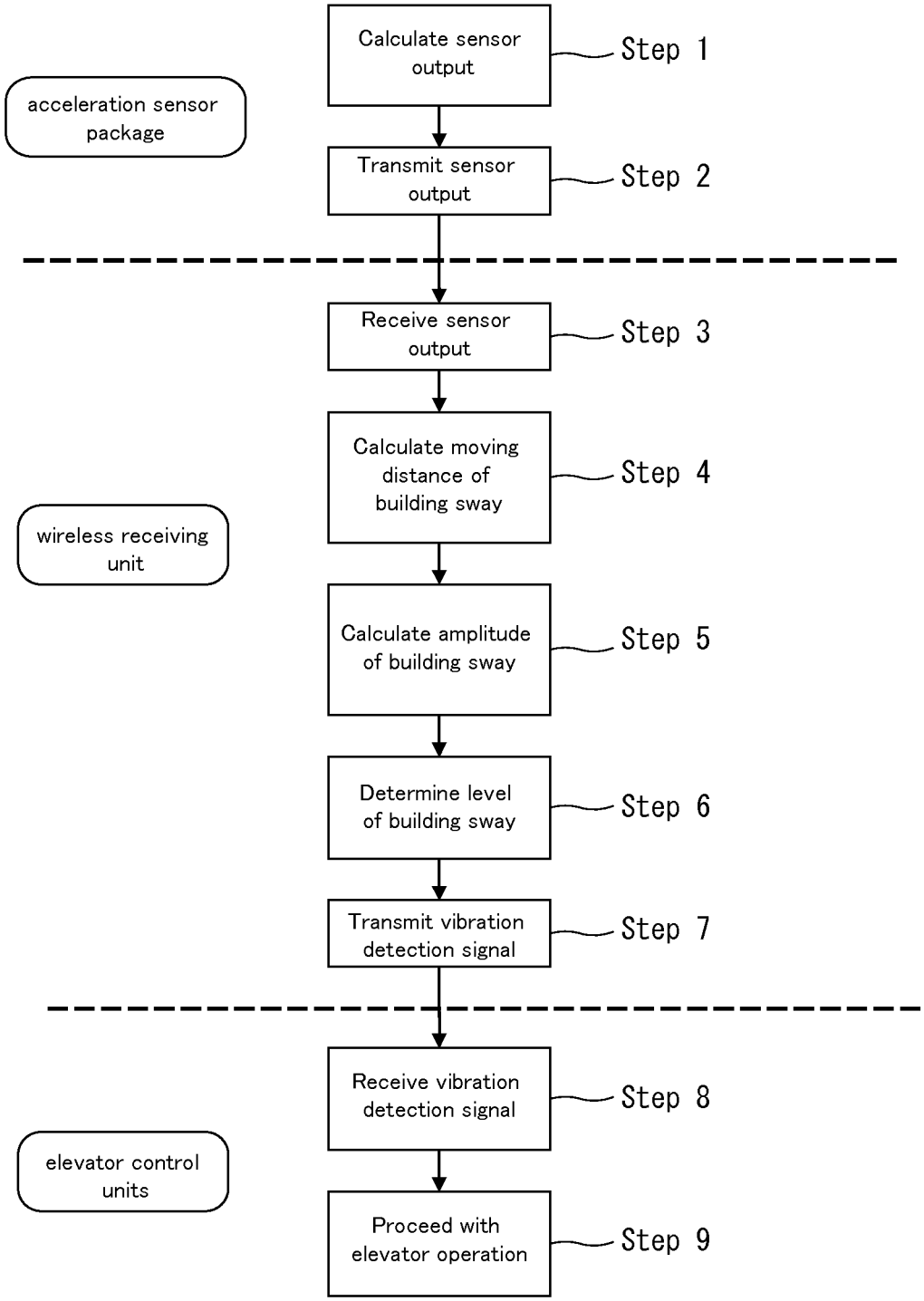
FIG. 4 is a flowchart showing an operation for monitoring a building sway.

When the signal level of the amplitudes of the building sway calculated in step 5 of FIG. 4 is below a predetermined first threshold value, the second arithmetic unit (CPU) 19 of the wireless receiving unit 12 determines that there is no problem with the level of the building sway, and thus the second arithmetic unit (CPU) 19 does not send any vibration detection signals to the control device of an elevator. In other words, the evaluation of the building sway is reset.

If the calculated signal level of the amplitudes is at or greater than the first threshold value and is smaller than a second threshold value (i.e. the signal level is SQ1), the second arithmetic unit (CPU) 19 starts detecting the frequency of the signals SQ1 with respect to time.

Here, if the second arithmetic unit (CPU) 19 detects signals SQ1 plurality of times within the first 30 seconds, and if the second arithmetic unit (CPU) 19 detects at least one signal SQ1 within next 30 seconds, the second arithmetic unit (CPU) 19 determines that the level of the building sway is abnormal, and a vibration detection signal CSQ1 indicating abnormality is transmitted to the respective elevator control systems. The respective elevator control systems then proceed with an elevator operation corresponding to the level of the building sway. For instance, the elevator system carries out an automatic diagnostic operation.

On the other hand, after detecting signals SQ1 plurality of times within the first 30 seconds, if there is no signal SQ1 of the same level detected within next 30 seconds, the second arithmetic unit (CPU) 19 determines that there is no problem with the level of the building sway, and the evaluation of the building sway is reset.

When the signal level of the amplitudes of the building sway calculated in step 5 of FIG. 4 is at or exceeds the second threshold value (i.e. the signal level is SQ2), once the second arithmetic unit (CPU) 19 detects at least one signal SQ2, the second arithmetic unit (CPU) 19 determines that the level of the building sway is high, and a vibration detection signal CSQ2 is transmitted to the respective elevator control systems so as to shut down the elevators immediately.

While the evaluation of the level of the building sway according to one embodiment has been described as being performed by comparing the signal level of the calculated amplitudes of the building sway with two thresholds, it should be understood that the evaluation of the level of the building sway could be evaluated by comparing an acceleration itself (i.e. acceleration detected by the acceleration sensor 14) with at least one predetermined threshold value of acceleration. Also, while the evaluation of the level of the building sway according to one embodiment has been described as being evaluated on the basis of the detection frequency of the respective signals with two different intensities (i.e. SQ1 and SQ2 signals) detected in a predetermined time interval, it should be understood that it could be evaluated on the basis of the detection frequency of the signals having more than two different intensities, or it could be assessed on the basis of the signal strength.

As described above, according to exemplary embodiments, the building sway operation system 10 is configured to detect the reciprocating motion of a movable mass of an existing active vibration control device responsive to the occurrence of earthquakes or strong winds, rather than detecting the sway of building itself. As the reciprocating motion of the movable mass is amplified in comparison to the sway of the building, it is not necessary to provide any complicated detection mechanisms to accurately detect long-period of earthquakes and the sway of the building itself. Moreover, as the acceleration sensor package 11 is powered by wireless power transfer, the acceleration sensor package 11 can be easily installed on the exterior of the movable mass 6 of the existing active vibration control device in a building. With this configuration, the acceleration sensor package 11 does not interfere with the movement of the movable mass 6. Accordingly, the building sway operation system 10 of exemplary embodiments can ensure the detection of the swing or sway of the building even using compact, lightweight and inexpensive acceleration sensors.

By utilizing an acceleration sensor in combination with an existing active vibration control device for building sway, exemplary embodiments can provide a building sway operation system 10 that can easily retrofit over an existing elevator system without substantial modifications and can control pluralities of elevator systems installed in a building with a compact, lightweight, and inexpensive device. Furthermore, as the acceleration sensor of exemplary embodiments is configured to be disposed on an active vibration control device, it is also possible to perform a detection test of the acceleration sensor by driving a movable mass for a test operation.

Accordingly, embodiments provide a building sway operation system for an elevator that can easily retrofit over an existing elevator system without substantial modifications and can accurately detect the sway of the building due to long-period earthquakes and strong winds without any complicated detection mechanisms. Embodiments provide a building sway operation system that can control pluralities of elevator systems installed in a high-rise building with a simple, compact, and lightweight, but inexpensive device While the present invention has been particularly shown and described with reference to the exemplary embodiments as illustrated in the drawings, it will be recognized by those skilled in the art that various modifications may be made without departing from the spirit and scope of the invention as disclosed in the accompanying claims.

What is claimed is:

1. A building sway operation system for an elevator comprising:

an acceleration sensor; and a data receiving unit for receiving a sensor output from the acceleration sensor, wherein the acceleration sensor is mounted on a movable mass of an active vibration control device for a building;

wherein the data receiving unit is configured to calculate a moving distance of the building sway per unit time from the sensor output from the acceleration sensor, and calculate an amplitude value of the building sway from the moving distance of the building sway per unit time without detecting sway of the building.

2. The building sway operation system of claim 1, wherein the acceleration sensor is powered by wireless power transfer from the data receiving unit.

3. The building sway operation system of claim 1, wherein the acceleration sensor transmits the sensor output to the data receiving unit via wireless communication.

4. The building sway operation system of claim 1, wherein the data receiving unit determines a level of the building sway by comparing the amplitude value of the building sway with at least one threshold value.

5. The building sway operation system of claim 4, wherein the data receiving unit transmits to at least one elevator control system a control signal for controlling an elevator operation according to the level of the building sway.

* * * * *